US005575055A

United States Patent [19]

Detable et al.

[11] Patent Number: 5,575,055

[45] Date of Patent: Nov. 19, 1996

[54] PROCESS FOR SHRINKING A RING ON A CYLINDRICAL SUPPORT BEHIND AN AXIAL OBSTACLE

[75] Inventors: Pascal Detable, Gievres; Michel Andre, Romorantin Lanthenay, both of France

[73] Assignee: Etablissements Caillau, Issy Les Moulineaux, France

[21] Appl. No.: 346,014

[22] Filed: Nov. 29, 1994

[30] Foreign Application Priority Data

Dec. 3, 1993 [FR] France ..... 93 14514

[51] Int. Cl.[6] ..... B21D 39/00

[52] U.S. Cl. ..... 29/508; 29/237; 72/402

[58] Field of Search ..... 72/402, 410, 481, 72/303; 29/237, 508, 509, 515

[56] References Cited

U.S. PATENT DOCUMENTS

| | | | |
|---|---|---|---|
| 642,692 | 2/1900 | Hoffman | 72/402 |
| 3,568,495 | 3/1971 | Duffield | 72/402 |
| 3,762,209 | 10/1973 | Herndon et al. | 72/402 |
| 4,472,959 | 9/1984 | Fencl | 72/481 |
| 4,885,928 | 12/1989 | Davis et al. | 72/410 |
| 5,022,248 | 6/1991 | Brooks | 72/481 |

FOREIGN PATENT DOCUMENTS

| | | | |
|---|---|---|---|
| 254805 | 6/1967 | Austria | 72/410 |
| 2155679 | 12/1989 | France . | |
| 1907956 | 10/1969 | Germany . | |
| 2612345 | 11/1976 | Germany . | |
| 4206439 | 9/1993 | Germany . | |
| 522928 | 3/1958 | Italy | 72/410 |
| 1094653 | 5/1984 | U.S.S.R. | 72/402 |
| 21049 | of 1914 | United Kingdom | 29/237 |

*Primary Examiner*—Daniel C. Crane
*Attorney, Agent, or Firm*—Marshall & Melhorn

[57] ABSTRACT

The present invention relates to a process for shrinking a ring to be shrunk, placed around an object to be clamped on a cylindrical support and behind an axial obstacle connected to said support. The process comprises the following steps of: a) fitting a shrinking tool around the support, over the axial obstacle, until its jaws in expanded position are disposed in the radial plane of the ring to be shrunk, b) positioning in the jaws, by the rear of the axial obstacle, a spacer presenting a central opening adapted to the ring to be shrunk, and c) finally, tightening the shrinking tool to bring the jaws and the spacer that they contain in their retracted positions.

2 Claims, 2 Drawing Sheets

PROCESS FOR SHRINKING A RING ON A CYLINDRICAL SUPPORT BEHIND AN AXIAL OBSTACLE

FIELD OF THE INVENTION

The present invention relates to a process for shrinking a ring to be shrunk, placed around an object to be clamped on a cylindrical support and behind an axial obstacle connected to the support, by means of a shrinking tool comprising jaws capable of adopting an expanded position and a retracted position.

BACKGROUND OF THE INVENTION

The use in industry of rings to be shrunk presents a certain advantage insofar as they are inexpensive and ensure permanent clamping.

For example, shrunk rings are much appreciated in the automobile industry to ensure fixation of the gussets disposed around mechanical connections, such as homokinetic joints, between two parts of a transmission of a vehicle, particularly of the "front-wheel drive" type. During assembly of such a transmission, the first end of the median shaft of the transmission, for example the output shaft of the motor, is first fitted in a first homokinetic joint bowl, and a first gusset is positioned, whose wide end surrounds the bowl and whose narrow end surrounds the median shaft. A conventional process may then be employed for shrinking a large ring on the wide end which, on the bowl side, is easily accessible to a tool for shrinking this large ring, and a small ring on the narrow end which, on the median shaft side, is accessible to another tool for shrinking this small ring.

From the second end of the median shaft, there is then fitted on this shaft a second gusset by its narrow end. A problem is raised when, after having fitted the second end of the median shaft in a second homokinetic joint bowl and having displaced the second gusset axially so that its wide end surrounds the second bowl and its narrow end surrounds the median shaft in the vicinity of its second end, it is proposed to fix this second gusset. In fact, although the wide end is accessible to a shrinking tool on the second bowl side, and may therefore be fixed by a large ring to be shrunk, access of a shrinking tool to the narrow end of the second gusset is prevented by the first and second bowls.

In fact, although there is nothing to prevent a small ring to be shrunk from being disposed on the narrow end of the second gusset before fitting the latter on the shaft, no known process allows such a ring to be shrunk, which renders use thereof impossible.

To fix the narrow end of the second gusset, one is consequently obliged to employ, in place of a shrunk ring which presents the advantages set forth hereinbefore, a band clamp fitting which is more expensive and less practical.

The state of the art generally does not allow use of a shrunk ring for clamping an object on a cylindrical support when an axial obstacle is connected to the support, in front of that part of said support where it is desired to clamp this object.

As has just been seen, this presents practical drawbacks and involves excess costs.

It is an object of the present invention to overcome these drawbacks by proposing a process which makes it possible to use a ring to be shrunk, even when it must be placed behind an axial obstacle, as well as a device for carrying out such a process.

SUMMARY OF THE INVENTION

This process comprises the following steps of:

a) fitting the shrinking tool, with its jaws in expanded position, around the support, over the axial obstacle, until said jaws are disposed in the radial plane of the ring to be shrunk, b) positioning in the jaws in expanded position of the shrinking tool, by the rear of the axial obstacle, a spacer presenting a substantially circular central opening and itself capable of adopting a retracted position and an expanded position in which the outer periphery of said spacer is adapted to the inner periphery of the jaws in expanded position, while the diameter of its central opening is substantially equal to that of the ring to be shrunk, c) finally, tightening the shrinking tool in order to bring the jaws and the spacer that they contain into their respective retracted positions.

As will be readily understood, this process makes it possible to shrink a ring to be shrunk placed behind an axial obstacle. In the example mentioned above, which concerns the fixation of the gussets on a transmission shaft, this process even makes it possible to use only one shrinking tool of which the inner periphery of the jaws is adapted to the shrink of the large ring to be shrunk, in order successively to shrink this large ring then, by inserting in the jaws a spacer of the type mentioned above, the small ring to be shrunk.

The process advantageously employs a spacer which comprises at least two parts mobile with respect to one another in its plane, in which case the step of positioning the spacer is preceded by a step of spacing said parts apart with respect to one another in order to define a passage sufficient for at least the support of the object to be clamped and by a step of bringing these parts together around said support until the passage is substantially eliminated.

The process of shrinking and the device for carrying it out will be more readily understood on reading the following description with reference to the accompanying drawings, in which.

DESCRIPTION OF PREFERRED EMBODIMENT

Figure 1:
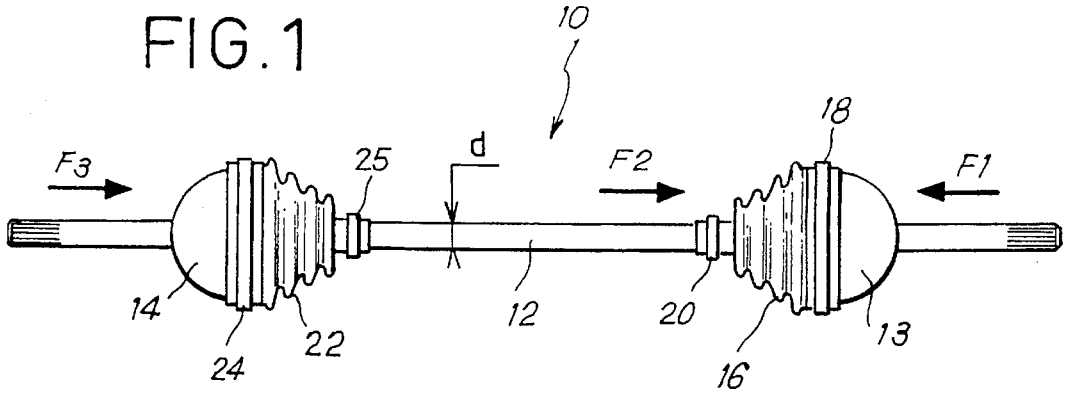
FIG. 1 shows an assembled automobile transmission.

Referring now to the drawings, FIG. 1 shows an assembled transmission 10 and presents the problem to be solved. This transmission 10 comprises a median transmission shaft 12 at the ends of which are coupled first and second homokinetic joint bowls respectively designated by references 13 and 14. A first gusset 16 presents a wide end clamped on the bowl 13 by means of a first ring 18 and a narrow end clamped on the shaft by means of a second ring 20. As has been indicated above, the first ring 18 is easily accessible on the bowl side in the direction of arrow F1 and, if the second bowl 14 is not yet mounted, the second ring 20 is also accessible in the direction of arrow F2.

A second gusset. 22 presents a wide end which is fixed on the second bowl 14 by means of a large ring 24 and a narrow end which is clamped on the shaft but, this time, by means of a band clamp fitting 25. In fact, although the large ring 24 is accessible on the second bowl side in the direction of arrow F3, no known process makes it possible to shrink a ring located in the position of the clamp fitting when the first bowl 13 is already mounted. One is therefore obliged to use a band clamp fitting which presents, with respect to a ring to be shrunk, the drawbacks set forth in the preamble.

Figure 2:
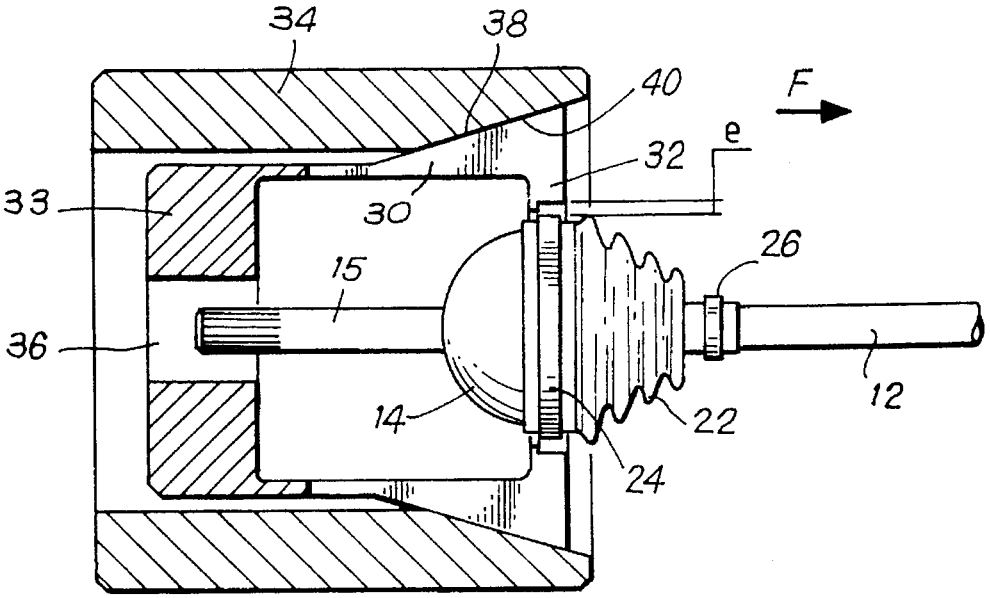
FIG. 2 shows the left-hand part of the transmission of FIG. 1 just before a large ring to be shrunk is shrunk on the wide end of a gusset.
Figure 3:
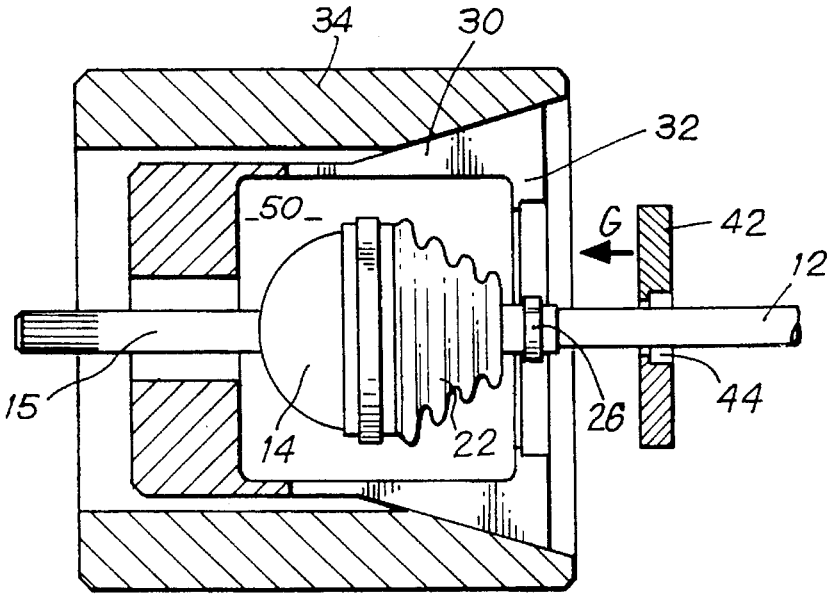
FIG. 3 is similar to FIG. 2 and illustrates the process for shrinking a small ring on the narrow end of the gusset.

The shrinking tool shown in FIGS. 2 and 3 comprises in known manner a shrinking clamp 30 provided with shrinking jaws 32 as well as a thrust collar 34 disposed around the shrinking clamp and mobile in translation with respect thereto. The shrinking clamp comprises an axial bore 36 which enables it to be fitted on a cylindrical support such as shaft 12 or the portion of shaft 15 and presents, over at least a part, a conical outer periphery 38. It must be understood that this cylindrical support may present a circular, polygonal or other section.

The thrust collar comprises, over a corresponding part, a conical inner periphery 40. To shrink the ring 24, after having brought the jaws 32 in its plane, the shrinking clamp 30 is maintained while displacing the thrust collar 34 in the direction of arrow F to tighten the shrinking jaws 32. In fact, these jaws 32 present an expanded position shown in FIG. 2, in which they are distant from ring 24 by a distance e, and a retracted position (not shown) to shrink the ring.

The jaws may in known manner be constituted by a plurality of portions of cone, spaced from one another to define the expanded position and brought together to define the retracted position. These portions of cone are fast over a part which determines a cylinder 33.

In the following specification, it will be considered that the direction of arrow F defines the "rearward" direction, i.e. that the shaft 12 lies to the rear of the bowl 14, the opposite direction obviously being the "forward" direction.

In FIGS. 2 and 3, the band clamp fitting 25 of FIG. 1 is replaced by a ring 26 to be shrunk. The bowl 14 and the gusset 22 constitute an axial obstacle behind which the ring 26 to be shrunk is located. This axial obstacle is connected to the support, i.e. it is not dismountable with a view to shrinking the ring 26. In the example shown, the obstacle is kinematically connected to the support constituted by the shaft 12.

FIGS. 2 and 3 enable the process for shrinking this ring 26 to be more readily understood. In a first step, the shrinking tool, comprising the shrinking clamp 30 and the thrust collar 34, is fitted over the axial obstacle, constituted by the bowl 14 and the gusset 22, until the jaws 32 are disposed in the radial plane of the ring 26 to be shrunk.

The inner periphery of the jaws 32 not being adapted to shrink this ring 26, a spacer 42 presenting a substantially circular, central opening 44 is positioned in these jaws in expanded position of the shrinking tool and by the rear of the axial obstacle, i.e. in the direction of arrow G of FIG. 3 (forwardly).

Figure 4:
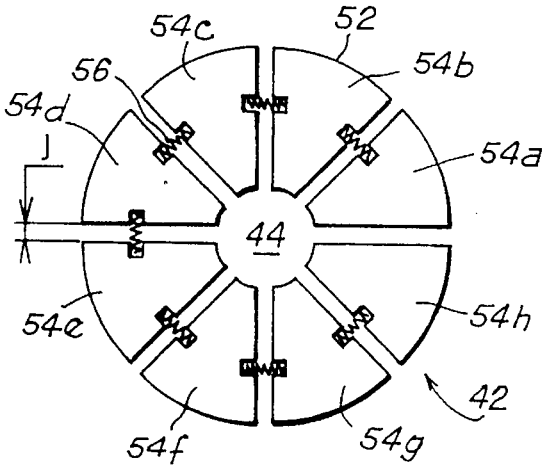
FIG. 4 shows a spacer in expanded position.
Figure 5:
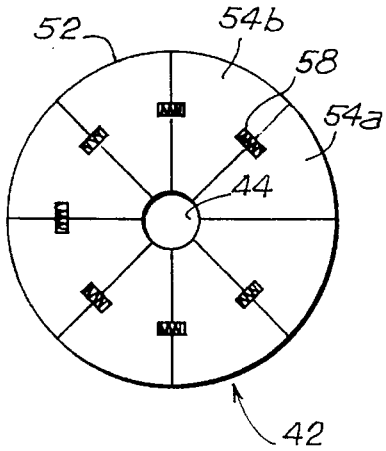
FIG. 5 shows the same spacer in retracted position.

The spacer 42 is capable of adopting a retracted position visible in FIG. 5 and an expanded position illustrated in FIG. 4. In this expanded position, the outer periphery of the spacer is adapted to the inner periphery of the jaws 32 of the shrinking tool when they are themselves in expanded position. This makes it possible to insert the spacer 42 in the jaws 32 in expanded position. Still in the expanded position of the spacer, the diameter of its central opening 44 is substantially equal to the diameter of the ring 26 to be shrunk, i.e. to the diameter that this ring presents before shrinking.

In the last step, the shrinking tool is tightened to bring the jaws 32 and the spacer 42 that they contain, into their respective retracted positions. Such tightening of the shrinking tool is effected by displacing the thrust collar 34 rearwardly, i.e. in the direction of arrow F of FIG. 2, while maintaining the shrinking clamp 30 fixed with respect to the ring 26.

Figure 6:
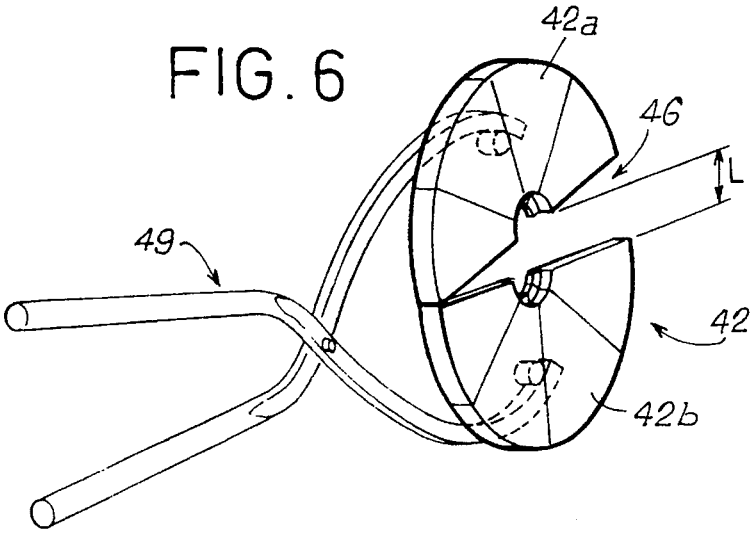
FIG. 6 shows a spacer in at least two parts displaced with respect to one another to define a passage.

As shown in FIG. 6, the spacer 42 advantageously comprises at least two parts mobile with respect to one another in its plane, respectively designated by references **42*a* and 42*b*. In that cafe, the step of positioning the spacer is preceded by a step of spacing parts 42*a* and 42*b* apart with respect to one another to define a passage 46 sufficient for at least the support of the object to be clamped. In the example shown, the minimum width L of the passage 46, at the entrance of the axial opening 44, must be at least equal to the diameter d of the transmission shaft 12. This makes it possible to position the spacer, not by fitting it axially on the shaft, but by bringing it radially and inserting this shaft via passage 46. Parts 42*a* and 42*b* are then brought together around the shaft 12 until the passage 46 is substantially eliminated. While keeping the spacer substantially in its expanded position, it may then be inserted in the jaws 32** of the suitably disposed shrinking tool.

The device for carrying out the process will now be described in greater detail, firstly with regard to the shrinking tool with reference to FIG. 3. As will be seen, the shrinking clamp 30 presents a cavity 50 defined rearwardly by the jaws 32 and which is adapted to contain the axial obstacle entirely, constituted, in the example shown, by the bowl 14 and the gusset 22. This makes it possible to bring the shrinking tool into a position where the jaws 32 are effectively in the radial plane of the ring 26 to be shrunk.

Spacer 42 will now be more particularly described with reference to FIGS. 4 to 6. As has been indicated hereinbefore, this spacer comprises the central opening 44 which is substantially circular but which, depending on the shape which it is desired to give the ring once shrunk, may also present a slightly different shape.

In the example shown, the outer periphery 52 of the spacer 42 is also substantially circular. It will be noted that it is merely important that this periphery is adapted to the inner periphery of the jaws 32 of the shrinking tool. The shrinking tool is firstly used directly to shrink a large ring 24; the inner periphery of its jaws is therefore preferably substantially circular. The second ring 26 is shrunk only afterwards, via the spacer 42.

In certain cases, the shrinking tool will be used only for shrinking a ring to be shrunk located to the rear of an axial obstacle possibly different from the one, cited as example, constituted by a homokinetic joint bowl and a gusset.

In fact, the process and the device for carrying it out may be used whenever it is desired to shrink a ring on a cylindrical support which, on a first side, called "front side", comprises at least one axial obstacle which prevents the use of a conventional shrinking tool via this first side. It may happen that this front side be nonetheless the most accessible side, either because the so-called "rear" side also presents an obstacle, such as the first homokinetic joint 13 and the first gusset 16 of FIG. 1, of because the position of the rear end of the support is incompatible with the use of a conventional shrinking tool; this latter eventuality is possible when the distance between the rear end of the support and another element is too short.

In that case, it is not necessary that the inner periphery of the jaws be circular; it suffices that its shape allow the efforts acting on the spacer during shrinking of the ring, to be distributed in accordance with the user's wishes, i.e., most often, homogeneously.

If the spacer comprises two parts 42*a* and 42*b* mobile with respect to each other in its plane, it is advantageously provided that these two parts are respectively fast with a first and second lever of pincers such as pincers 49 shown schematically in FIG. 6. In this way, the step of spacing parts 42*a* and 42*b* apart and the step of bringing them together, are effected by actuating the levers of the pincers.

As is seen in the Figures, spacer 42 is advantageously constituted by a plurality of rigid angular sectors. In the example shown, these sectors are eight in number, respectively designated by references 54*a*, 54*b*, 54*c*, 54*d*, 54*e*, 54*f*, 54*g* and 54*h*. At least certain of these sectors are connected together by elastic elements 56. As shown in FIG. 4, the expanded position of the spacer is determined by the relaxed position of the elastic elements. On the contrary, to bring the spacer 42 into the retracted position illustrated in FIG. 5, these elastic elements are retracted so as substantially to eliminate the clearance J between the rigid angular sectors.

In the example shown, no direct connecting element, such as an elastic element 56, is provided between the two contiguous angular sectors 54*a* and 54*h*. This makes it possible to define the passage 46 mentioned above, considering, with reference to FIG. 6, that part 42*a* of the spacer comprises a first group of angular sectors 54*a*, 54*b*, 54*c* and 54*d*, while part 42*b* comprises a second group of sectors 54*e*, 54*f*, 54*g* and 54*h*. When the two parts of the spacer are spaced apart, the elastic element which joins sectors 54*d* and 54*e* constitutes a hinge.

If the position of the rear end of the support makes it possible to fit the spacer axially, without, however, leaving the necessary space available for the shrinking tool, all the angular sectors may be connected together by elastic elements.

The elastic elements 56 may be constituted by springs which, when the spacer is in retracted position, are capable of being housed in cavities in the radial edges of the rigid angular sectors, such as the cavity 58 defined by two bores made in the sectors 54*a* and 54*b*. These elements may also be made of an elastically deformable material such as rubber.

What is claimed is:

1. A process for shrinking a ring to be shrunk, said ring having, before shrinking, a first diameter and being placed around an object to be clamped on a cylindrical support having an axis, an axial obstacle being connected to said support and having a second diameter greater than said first diameter and having an axial length terminating at first and second ends the ring being disposed behind said obstacle in a first axial direction, the process comprising the steps of:

a) providing a shrinking tool which includes jaws having an inner periphery and being capable of adopting an expanded position and a retracted position, and which further includes a cavity, disposed axially adjacent said jaws and having diametral dimensions which, in the expanded position as well as in the retracted position of the jaws, are greater than said second diameter of the obstacle;

b) fitting the shrinking tool, with the jaws thereof in expanded position, by moving the jaws of the shrinking tool in the first axial direction from the first end to the second end of the obstacle so that the shrinking tool is over the axial obstacle with said cavity placed around said axial obstacle;

c) positioning the shrinking tool until the jaws are disposed, in said first axial direction, behind said obstacle, in a radial plane of the ring to be shrunk, with said cavity placed around said obstacle d) positioning a spacer in the jaws in expanded position, by the rear of the axial obstacle, said spacer presenting a substantially circular central opening and an outer periphery, and being capable of adopting a retracted position and an expanded position in which said outer periphery of said spacer is adapted to the inner periphery of the jaws in expanded position thereof, while a diameter of the central opening is substantially equal to the diameter of the ring to be shrunk, and e) tightening the shrinking tool in order to bring the jaws and the spacer disposed therein into their respective retracted positions, so as to bring the ring to a third diameter smaller than said first diameter while the cavity of the shrinking tool is placed around the obstacle.

2. The process according to claim 1, wherein, the spacer includes a first part and a second part which are displaceable with respect to one another in a plane of said spacer, and wherein the step of positioning the spacer in the jaws is preceded by the steps of displacing said first and second parts with respect to one another so as to bring said spacer in an open position in which a passage having a width at least equal to a diametral dimension of the support is delimited between said first and second parts, displacing the spacer in said open position relatively to the support so as to pass the support through the passage until said central opening is placed around said support, and bringing said first and second parts of the spacer together so as to bring the spacer in a closed position in which said passage is substantially closed, and wherein said step of positioning the spacer in the jaws includes a step of displacing said spacer in said closed position toward the jaws in a second axial direction opposite said first axial direction, until said spacer is disposed in the jaws.

* * * * *